US007891951B2

(12) United States Patent
Tanahashi

(10) Patent No.: US 7,891,951 B2
(45) Date of Patent: Feb. 22, 2011

(54) FAN WITH IMPROVED HEAT DISSIPATION

(75) Inventor: Kosei Tanahashi, Kanagawa-ken (JP)

(73) Assignee: International Business Machines Corporation, Armonk, NY (US)

( * ) Notice: Subject to any disclaimer, the term of this patent is extended or adjusted under 35 U.S.C. 154(b) by 50 days.

(21) Appl. No.: 12/053,586

(22) Filed: Mar. 22, 2008

(65) Prior Publication Data

US 2008/0166236 A1 Jul. 10, 2008

Related U.S. Application Data

(62) Division of application No. 11/299,994, filed on Dec. 12, 2005, now Pat. No. 7,713,030.

(51) Int. Cl.
*F04D 29/24* (2006.01)

(52) U.S. Cl. ..... 416/236 R

(58) Field of Classification Search ..... 416/227 A, 416/231 R, 231 B, 236 R, 223 B
See application file for complete search history.

(56) References Cited

U.S. PATENT DOCUMENTS 1,868,528 A * 7/1932 Gardner ..... 416/236 R
D110,876 S * 8/1938 Preston ..... D23/413
2,222,787 A 11/1940 Stadler
2,616,764 A * 11/1952 Parrish ..... 406/97
4,046,488 A * 9/1977 Wickham ..... 416/210 R
4,142,844 A * 3/1979 Brattstrom ..... 417/423.15
5,403,160 A * 4/1995 You ..... 416/223 R
5,967,754 A * 10/1999 Chou ..... 416/210 R
2005/0147498 A1 * 7/2005 Chien et al. ..... 416/236 R

OTHER PUBLICATIONS

Report regarding Office Action in Chinese counterpart patent application, Office action dated Feb. 15, 2008.

* cited by examiner

*Primary Examiner*—Nathaniel Wiehe
(74) *Attorney, Agent, or Firm*—Vazken Alexanian

(57) ABSTRACT

A fan includes a rotatable center member that is centered relative to an axis of rotation of the fan. The fan includes a number of blades radially extending from the rotatable center member. Each blade may have one or more ribs extending therefrom non-parallel to the axis of rotation of the fan. Each blade may be may be flat in shape, except for the ribs extending therefrom, or it may have a cycloidal curvature that curves away from the direction in which the rotatable center member rotates. In addition to or in lieu of the ribs, each blade may have a side profile that is non-linear. The side profile may be a zigzag or a curvy shape. The side profile may have one or more notches pointed in a direction opposite that in which the rotatable center member rotates, or may have one or more holes extending through the blade.

1 Claim, 12 Drawing Sheets

FAN WITH IMPROVED HEAT DISSIPATION

RELATED APPLICATIONS

The present patent application is a divisional of the previously filed patent application entitled "fan with improved heat dissipation," filed on Dec. 12, 2005, and assigned Ser. No. 11/299,994.

FIELD OF THE INVENTION

The present invention relates to fans, such as fans that are used in conjunction with computing devices to aid in the removal of heat from components thereof.

BACKGROUND OF THE INVENTION

Modern computing devices generate relatively large amounts of heat. For instance, central processors, graphics processors, and other semiconductor and other components of computing devices generate relatively large amounts of heat. In order for the computing devices to perform effectively without failure, this generated heat is desirably removed from the computing devices, in a process referred to as cooling.

In passive cooling, heat sinks are commonly placed on the components of computing devices that generate heat. A heat sink is typically made of metal, and has a number of fins extending from a base that physically contacts a computing device component like a processor. By thermal conductivity, the heat moves from the component of the computing device to the base of the heat sink, and finally to the fins of the heat sink. Passive cooling is advantageous in that it is a silent cooling approach, but is disadvantageous in that it is unable to remove large amounts of heat.

Therefore, in active cooling, fans are typically employed, either alone or in relation to heat sinks. A fan generally sucks the heated air from near a computing device component away from the computing device component. A given computing device may employ a number of different fans. For instance, there may be fans placed on each computing device component that generates a relatively large amount of heat, as well as an exhaust fan that removes the heat from the case of the computing device itself. Alternatively, there may just be fans placed on one or more computing device components that generate relatively large amounts of heat.

Active cooling is advantageous in that it is able to remove relatively large amounts of heat, but is disadvantageous in that it is a non-silent cooling approach. Furthermore, the effectiveness of fans generally increases with size and speed. Larger fans that have their blades rotate slowly can dissipate the same amount of heat as smaller fans that have their blades rotate more quickly. As a result, larger fans can be quieter than smaller fans. All other things being equal, a larger fan rotating at a relatively fast speed dissipates more heat than the same-sized fan rotating more slowly, or a smaller fan rotating at the same speed.

In some types of computing devices, such as laptop and notebook computers, the size of a fan that can be used to cool a heat-generating component is limited by the relatively limited amount of space available within the case of such a computing device. For instance, a laptop computer has a relatively small case, limiting the size of a fan that can be used to cool a heat-generating component of the computer. Therefore, fans used in conjunction with such computing devices may have to be sized smaller and rotate at relatively fast speeds, which can be undesirable to the user, due to the increased noise that results from fans rotating at relatively fast speeds.

Therefore, there is a need within the prior art for fans that dissipate greater amounts of heat. Such fans should be no greater than the same size and rotate at no greater than the same speed as existing fans, while dissipating greater amounts of heat. For these and other reasons, there is a need for the present invention.

SUMMARY OF THE INVENTION

The present invention relates to fans that have improved heat dissipation. A fan of one embodiment of the invention includes a rotatable center member that rotates in a given direction and is centered relative to an axis of rotation of the fan. The fan includes a number of blades radially extending from the rotatable center member. Each blade has one or more ribs extending therefrom non-parallel to the axis of rotation of the fan.

For example, each blade has a first side pointing in the direction in which the rotatable center member rotates, as well as a second side pointing in an opposite direction. The ribs of each blade may extend from the first side of the blade, from the second side of the blade, or from both the first side and the second side of the blade. The ribs may extend from these sides at the top of the blade and/or at the bottom of the blade. The ribs may be continuous from an end of the blade at which it is mounted to the rotatable center member, to another, opposite end of the blade. Alternatively, the ribs may be notched as they extend from one end of the blade to the other end of the blade.

A fan of another embodiment of the invention includes a rotatable center member to rotate in a given direction and centered relative to an axis of rotation of the fan. The fan includes a number of blades radially extending from the rotatable center member. Each blade has a side profile that is non-linear. The side profile may be a zigzag shape, such that it has series of Z-shapes or sideways V-shapes extending from the top of the blade to the bottom of the blade. The side profile may be a curvy shape, such that it has a series of S- or C-shapes extending from the top to the bottom of the blade. The side profile may have one or more notches pointed in a direction opposite that in which the rotatable center member rotates, and which extend only partially through the blade. The side profile may have one or more holes extending completely through the blade.

A fan of another embodiment of the invention includes a rotatable center member to rotate in a given direction and centered relative to an axis of rotation of the fan. The fan includes a number of blades radially extending from the rotatable center member. Each blade has a cycloidal curvature that curves away from the direction in which the rotatable center member rotates. Each blade may also have one or more ribs extending therefrom non-parallel to the axis of rotation of the fan, as has been described.

Embodiments of the invention provide for advantages over the prior art. For example, consider a fan having a given rotational speed, and a given size, which may be defined as the diameter of the fan. Within the prior art, such a fan has flat blades, and is able to dissipate a certain amount of sustained maximum heat, as well as being able to exhaust a gas, such as air, at a certain rate. By comparison, a fan according to the invention that has the same rotational speed and the same size is able to dissipate a greater amount of sustained maximum heat, and able to exhaust air or another gas at a greater rate, as compared to the prior art fan having flat blades.

Where the inventive fan also has flat blades, the added ribs, notches, or grooves increase the amount of sustained maximum heat that can be dissipated, as well as the rate at which air or another gas can be exhausted, as compared to the prior art fan having flat blades with no ribs, notches, or grooves. An inventive fan having blades with zigzag- or curvy-shaped side profiles also increases the amount of sustained maximum heat that can be dissipated, as well as the rate at which air or another gas can be exhausted, as compared to the prior art fan having flat, linear blades. Similarly, an inventive fan having blades that have cycloidal curvatures also increases the amount of sustained maximum heat that can be dissipated, as well as the rate at which air or another gas can be exhausted, as compared to the prior art fan having flat, linear blades.

Still other advantages, aspects, and embodiments of the invention will become apparent by reading the detailed description that follows, and by referring to the accompanying drawings.

BRIEF DESCRIPTION OF THE DRAWINGS

The drawings referenced herein form a part of the specification. Features shown in the drawing are meant as illustrative of only some embodiments of the invention, and not of all embodiments of the invention, unless otherwise explicitly indicated, and implications to the contrary are otherwise not to be made.

FIG. 2A is suggested for printing on the first page of the patent.

DETAILED DESCRIPTION OF THE DRAWINGS

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Figure 1A:
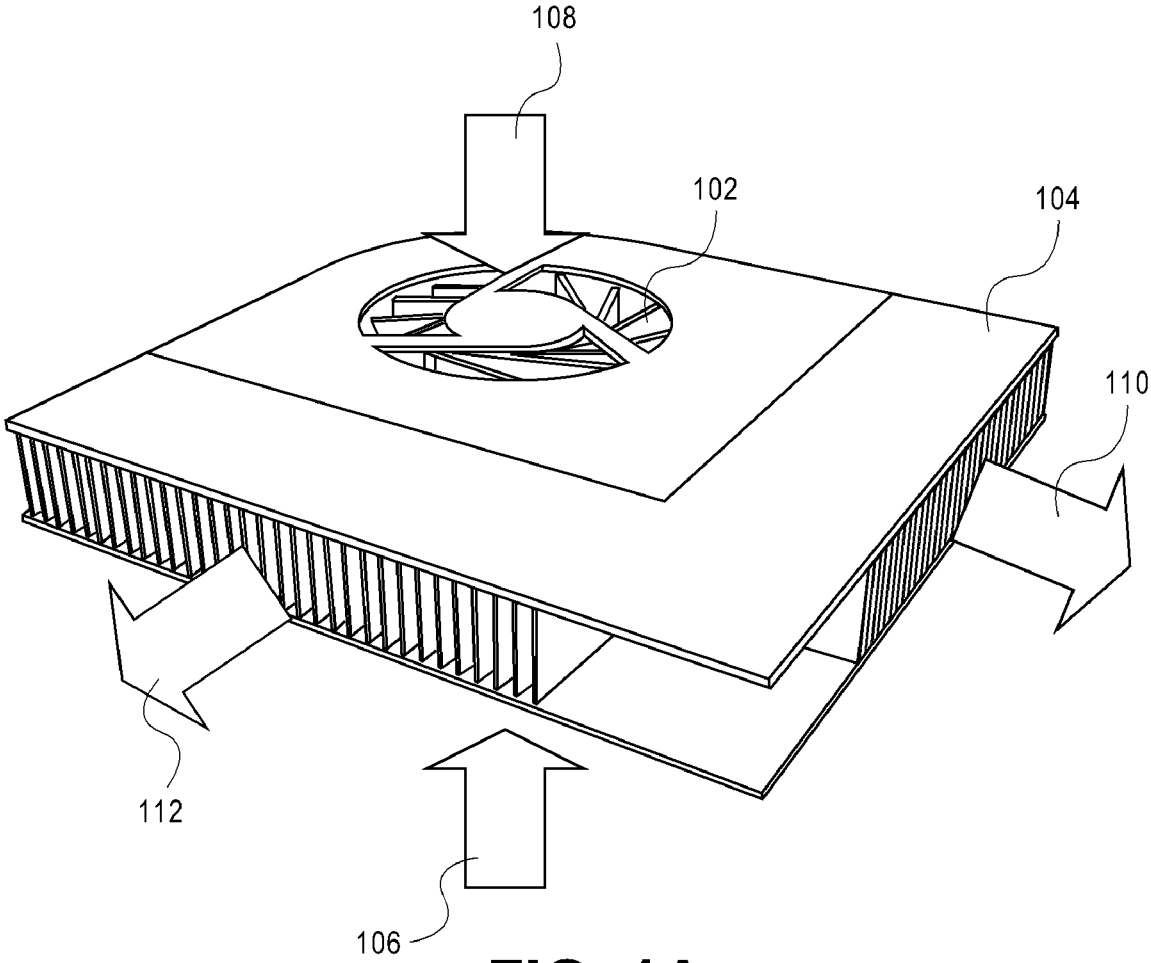
FIGS. 1A and 1B are a perspective view and a front view, respectively, of an operating environment in which a fan can be employed, according to an embodiment of the invention.
Figure 1B:
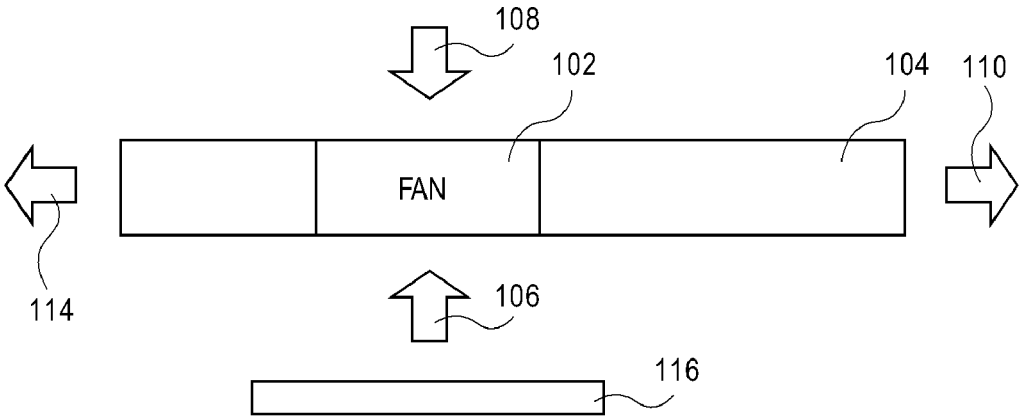

FIGS. 1A and 1B show an operating environment in which a fan 102 can be employed, according to an embodiment of the invention. FIG. 1A is specifically a perspective view of the operating environment, whereas FIG. 2B is specifically a front view of the operating environment. The fan 102 is situated within a frame 104. By movement or rotation of the fan 102, air or another gas is sucked into the fan 102, as indicated by the arrows 106 and 108, and exhausted, as indicated by the arrows 110, 112, and 114. In FIG. 1B specifically, a heat-generating component 116 is depicted. Thus, the heat generated by the component 116 is dissipated, via the fan 102 sucking the heated air or other gas as indicated by the arrow 106, and exhausting this heated air or other gas, as indicated by the arrows 110, 112, and 114. The fan 102 is therefore in one embodiment a centrifugal fan that intakes air or another gas from the top and the bottom, and exhausts the air or other gas in a traverse direction.

The heat-generating component 116 may be a processor, such as a central processor or a graphics processor, of a computing device, like a laptop or desktop computer, audio/video device, or another type of device that has computational capability. The heat-generating component 116 may be another type of semiconductor device within a computing device, or may be another type of component within a computing device. The heat-generating component 116 may further be a component within a type of device other than a computing device. In one embodiment, the fan 102 is an exhaust fan, for a computing or other type of device.

The frame 104 may be a heat sink for the heat-generating component 116, where in such instance it typically is in contact with the heat-generating component 116, which is not particularly depicted in FIG. 1B. The frame 104 in another embodiment may not be a heat sink, but rather a guide for guiding the air or other gas as desired. In still another embodiment, the frame 104 may not be present at all.

Figure 2A:
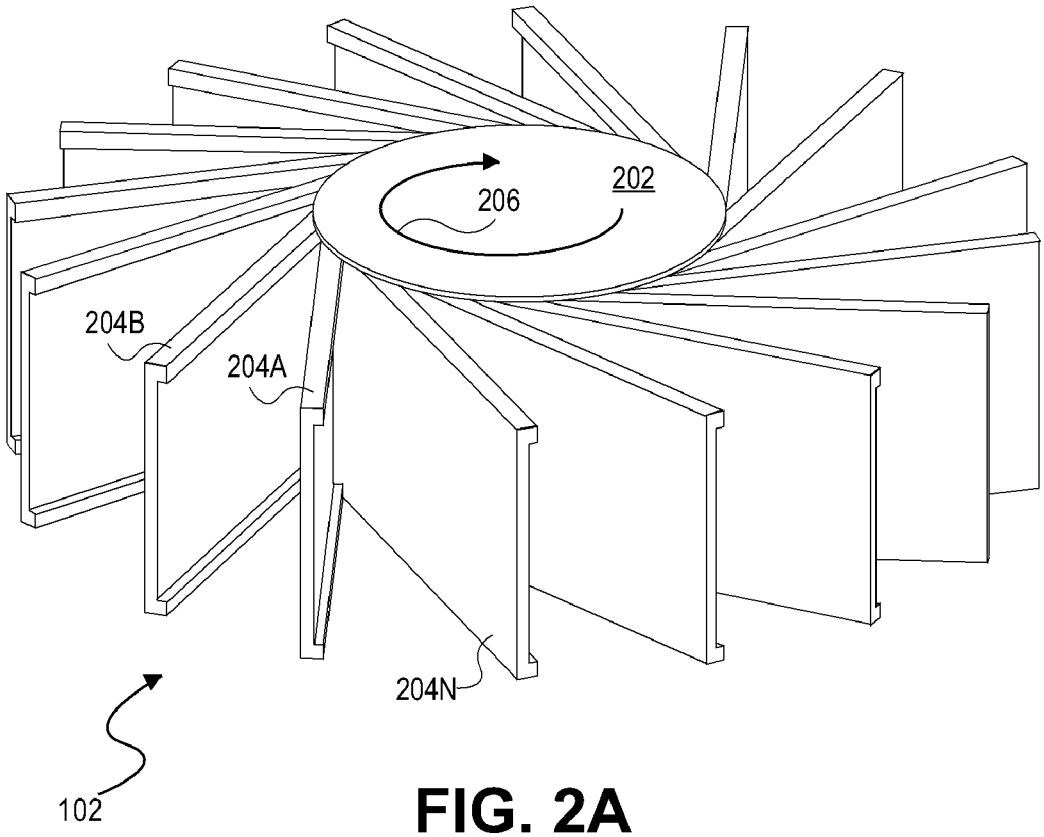
FIGS. 2A, 2B, and 2C are a perspective view of a fan, a top view of the fan with a single blade thereof illustrated for illustrative convenience, and a front view of a single blade of the fan illustrated for illustrative convenience, respectively, according to an embodiment of the invention.
Figure 2B:
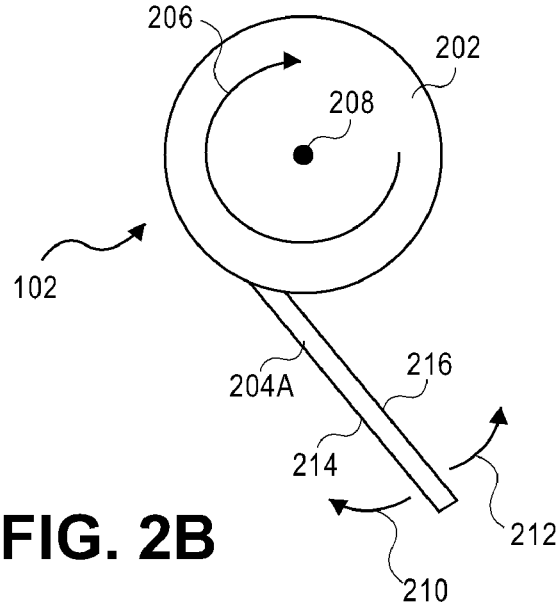
Figure 2C:
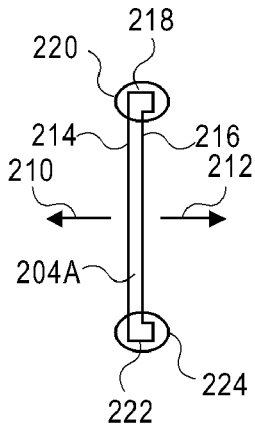

FIGS. 2A, 2B, and 2C are a perspective view of the fan 102, a top view of the fan 102 with a single blade 204A thereof illustrated for illustrative convenience, and a front view of the single blade 204A illustrated for illustrative convenience, respectively according to a specific embodiment of the invention. In FIG. 2A, the fan 102 is depicted as having a rotatable center member 202 that rotates in the direction indicated by the arrow 206. A number of blades 204A, 204B, . . . , 204N, collectively referred to as the blades 204, extend from the rotatable center member 202. The blades 204 are depicted in FIG. 2A as each extending from the rotatable center member 202 in a non-perpendicular fashion. However, in another embodiment, the blades 204 can extend from the rotatable center member 202 in a perpendicular fashion. The number of the blades 204 is not specifically limited to by embodiments of the invention, and in one embodiment the blades 204 are angularly equidistantly located around the rotatable center member 202.

In FIG. 2B, the fan 102 is depicted with just a single blade 204A thereof, as representative of all the blades 204, for illustrative convenience. That is, the fan 102 still has all the blades 204, but just one blade 204A is shown in FIG. 2B for illustrative clarity and convenience, and the description of the blade 204A pertains to all other of the blades 204. The rotatable center member 202 is shown in FIG. 2B as being centered relative to an axis of rotation 208 of the fan 102. The blade 204A has a side 214 that points in the direction in which the rotatable center member 202, and thus the blade 204A, rotates, as indicated by the arrows 206 and 210. The blade 204A also has a side 216 that points in the opposite direction, as indicated by the arrow 212.

In FIG. 2C, the blade 204A again is displayed as representative of all the blades 204, for illustrative convenience and clarity. The blade 204A has a top 218 and a bottom 222. At the top 218 is a rib 220 extending from the side 216 of the blade 204A. Similarly, at the bottom 222 is a rib 224 extending from the side 216 of the blade 204A. There are no ribs extending from the side 214 of the blade 204A in the embodiment of FIG. 2C. In another embodiment, there may just be one of the ribs 220 and 224, and not both of the ribs 220 and 224 as depicted in FIG. 2C.

Figure 3A:
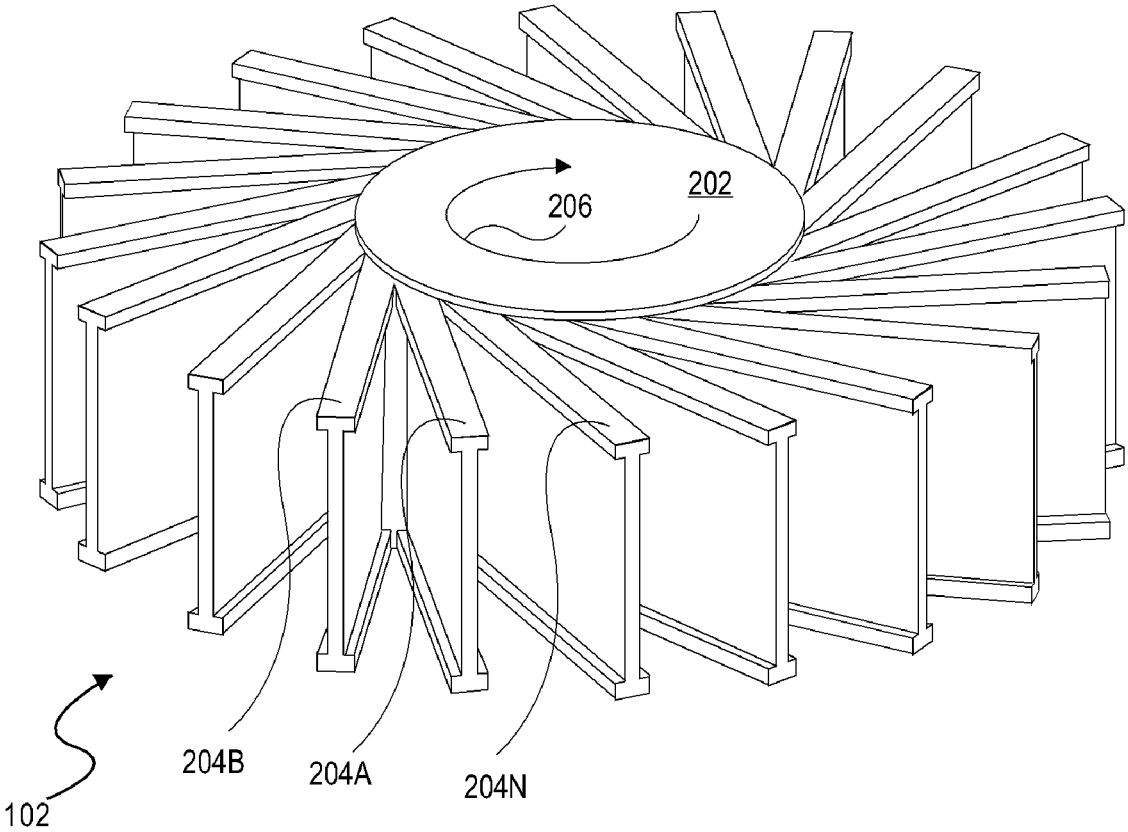
FIGS. 3A and 3B are a perspective view of a fan, and a front view of a single blade of the fan illustrated for illustrative convenience, respectively, according to another embodiment of the invention.
Figure 3B:
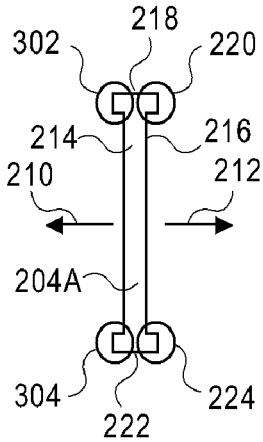

FIGS. 3A and 3B are a perspective view of the fan 102 and a front view of a single blade 204A of the fan 102 illustrated for illustrative convenience, respectively, according to another embodiment of the invention. A top view of the fan 102 is not depicted for this embodiment of the invention, as it is at least substantially identical to the top view of FIG. 2B that has been described. In FIG. 3A, the fan 102 again is depicted as having a rotatable center member 202 that rotates in the direction indicated by the arrow 206. As in FIG. 2A, the blades 204 extend from the rotatable center member 202 in FIG. 2A, too.

In FIG. 3B, the blade 204A of this embodiment is displayed as representative of all the blades 204, for illustrative convenience and clarity. The blade 204A has a top 218 and a bottom 222, as before. The blade 204A, also as before, has a side 214 that points in the direction in which the rotatable center member 202, and thus the blade 204A, rotates, as indicated by the arrow 210. The blade 204A also has a side 216 that points in the opposite direction, as indicated by the arrow 212.

In FIG. 3B, at the top 218 there is a rib 220 extending from the side 216 of the blade 204A, and at the bottom 222 there is a rib 224 extending from the side 216 of the blade 204A. However, unlike in the embodiment of FIG. 2C, in the embodiment of FIG. 3B there is also a rib 302 extending from the side 214 of the blade 204A at the top 218 of the blade 204A, and there is also a rib 304 extending from the side 214 of the blade 204A at the bottom 222 of the blade 204A. That is, in the embodiment of FIG. 2C, there are ribs 220 and 224 only extending from the side 216, whereas in the embodiment of FIG. 3B, there are ribs 220, 224, 302, and 304 extending from both the side 216 and the side 214. In another embodiment, there may be just the ribs 220 and 302, or just the ribs 224 and 304, and not all four of these ribs 220, 302, 224, and 304 as depicted in FIG. 3B.

Figure 4A:
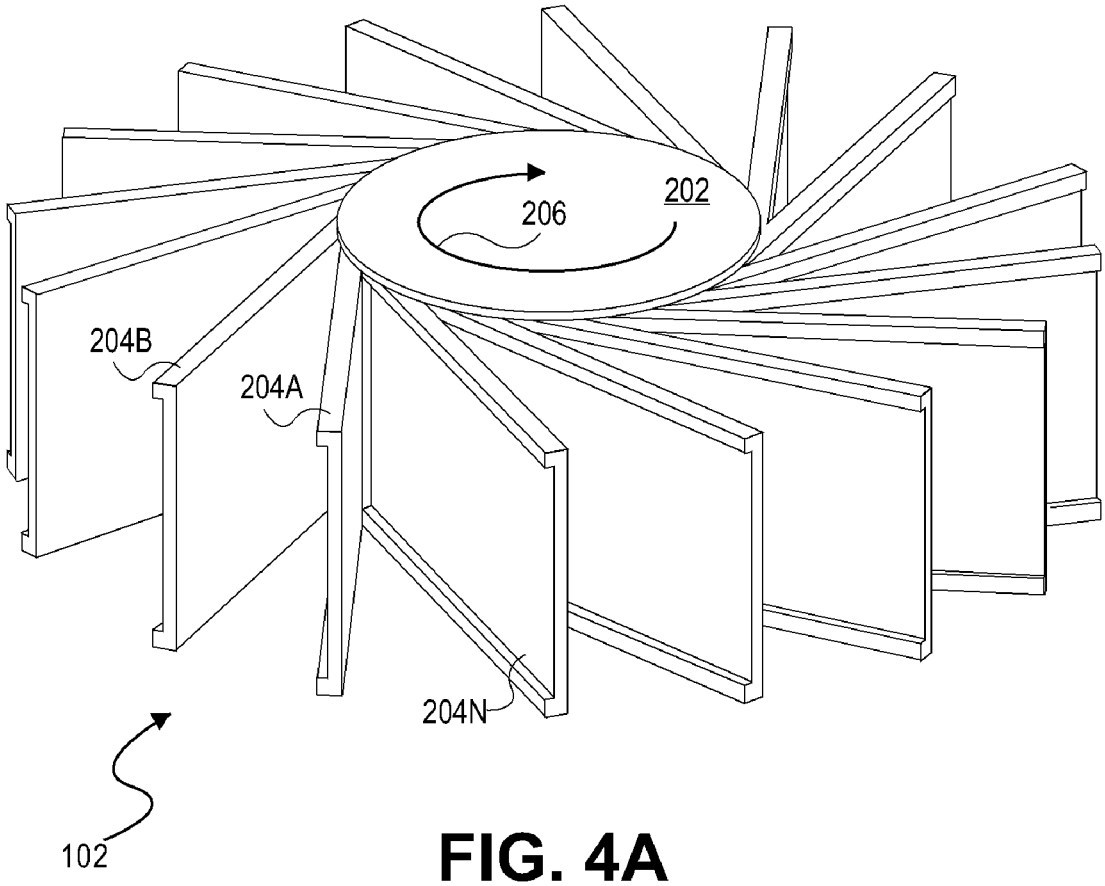
FIGS. 4A and 4B are a perspective view of a fan, and a front view of a single blade of the fan illustrated for illustrative convenience, respectively, according to another embodiment of the invention.
Figure 4B:
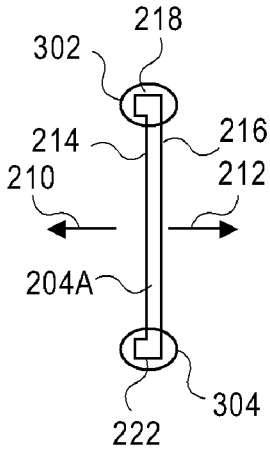

FIGS. 4A and 4B are a perspective view of the fan 102 and a front view of a single blade 204A of the fan 102 illustrated for illustrative convenience, respectively, according to another embodiment of the invention. A top view of the fan 102 is not depicted for this embodiment of the invention, as it is at least substantially identical to the top view of FIG. 2B that has been described. In FIG. 4A, the fan 102 again is depicted as having a rotatable center member 202 that rotates in the direction indicated by the arrow 206. As in FIGS. 2A and 3A, the blades 204 extend from the rotatable center member 202 in FIG. 4A, too.

In FIG. 4B, the blade 204A of this embodiment is displayed as representative of all the blades 204, for illustrative convenience and clarity. The blade 204A has a top 218 and a bottom 222, as before. The blade 204A, also as before, has a side 214 that points in the direction in which the rotatable center member 202, and thus the blade 204A, rotates, as indicated by the arrow 210. The blade 204A also has a side 216 that points in the opposite direction, as indicated by the arrow 212.

In FIG. 4B, at the top 218 there is a rib 302 extending from the side 214 of the blade 204A at the top 218, and there is also a rib 304 extending from the side 214 of the blade 204A at the bottom 222. However, unlike in the embodiments of FIGS. 2C and 3B, there are no blades extending from the side 216. In another embodiment, there may be just the rib 302 or just the rib 304, and not both the ribs 302 and 304 as depicted in FIG. 4B.

Figure 5:
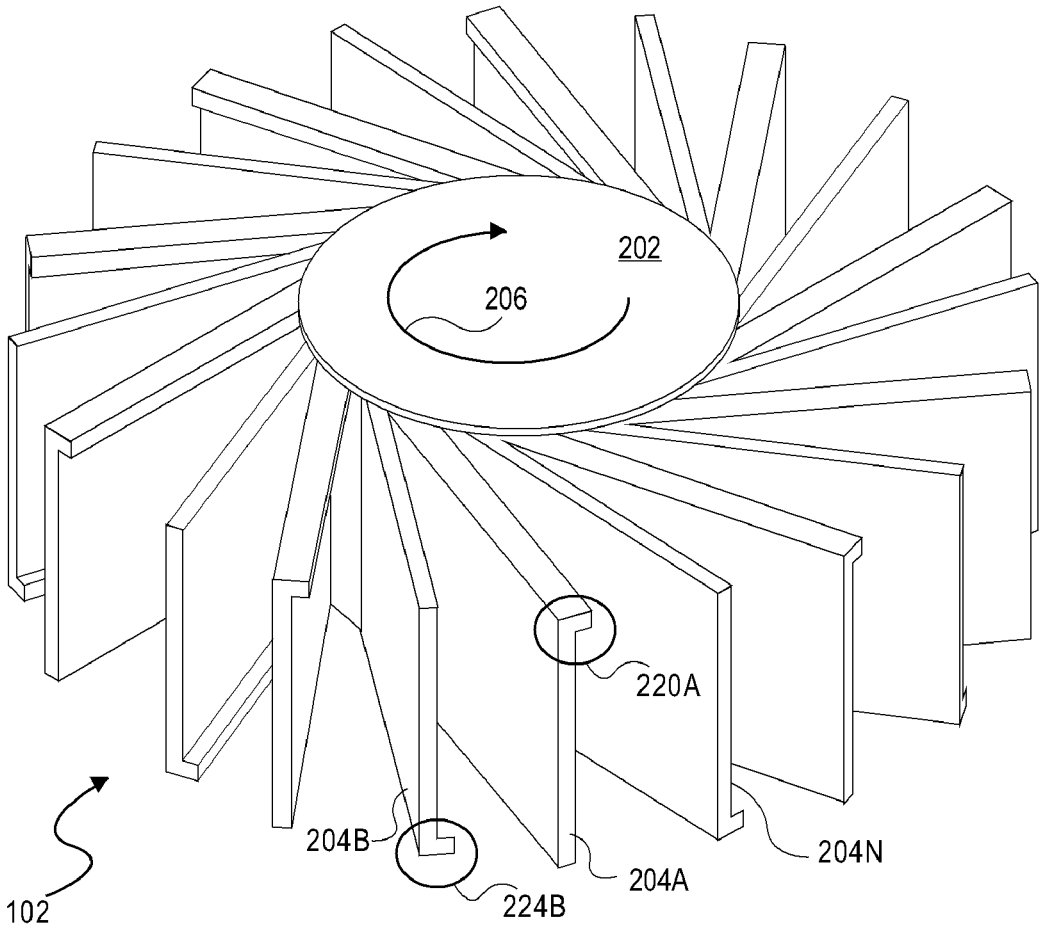
FIG. 5 is a perspective view of a fan, according to another embodiment of the invention.

FIG. 5 is a perspective view of the fan 102, according to another embodiment of the invention. A top view of the fan 102 is not depicted for this embodiment of the invention, as it is at least substantially identical to the top view of FIG. 2B that has been described. In FIG. 5, the fan 102 is again depicted as having a rotatable center member 202 that rotates in the direction indicated by the arrow 206. As in FIGS. 2A, 3A, and 4A, the blades 204 extend from the rotatable center member 202 in FIG. 5, too.

Each pair of the blades 204 in the embodiment of FIG. 5 has one blade having a rib extending from the top, and another blade having a rib extending from the bottom. Thus, the blades 204 as a whole have ribs extending therefrom on the top and the bottom in an alternating manner, such that one blade has a rib extending from its top, the next blade has a rib extending from its bottom, the next blade has a rib extending from its top, and so on. For example, the blade 204A has a rib 220A extending from its top, whereas the next blade 204B has a rib 224B extending from its bottom. The blade 204A in the embodiment of FIG. 5 may thus be considered the same as the blade 204A of FIG. 2C, except that it does not have the rib 224 at the bottom 222. The blade 204B in the embodiment of FIG. 5 may also be considered the same as the blade 204A of FIG. 2C, except that it does not have the rib 220 at the top 218.

In the embodiment of FIG. 5, the ribs of all the blades 204, such as the ribs 220A and 224B of the blades 204A and 204B, extend from the side pointing in the opposite direction to the direction in which the rotatable center member 202, and thus the blades 204 themselves, rotates, as indicated by the arrow 206. That is, using the reference numbers of FIG. 2C, the ribs of all the blades 204 in the embodiment of FIG. 5 extend from the side 216 denoted in FIG. 2C in the direction indicated by the arrow 212 denoted in FIG. 2C. However, in another embodiment, the ribs of all the blades 204 may instead extend from the side pointing in the same direction in which the rotatable center member 202 rotates, as indicated by the arrow 206. Using the reference numbers of FIG. 2C, in this other embodiment, the ribs of all the blades 204 extend from the side 214 denoted in FIG. 2C in the direction indicated by the arrow 210 denoted in FIG. 2C.

In the embodiments that have thus far been described, the ribs of the blades 204 of the fan 102 are all continuous, or contiguous, in extending from a first end of a blade at which the blade is mounted to or extend from the rotatable center member 202, to a second, opposite end of the blade. That is, each rib extends the full length of a corresponding blade, from the first end of the blade to the second, opposite end of the blade. However, in other embodiments of the invention, the ribs may each be notched at one or more locations or positions along the length of a corresponding blade, as the rib extends from the first end of the blade to the second, opposite end of the blade.

Figure 6A:
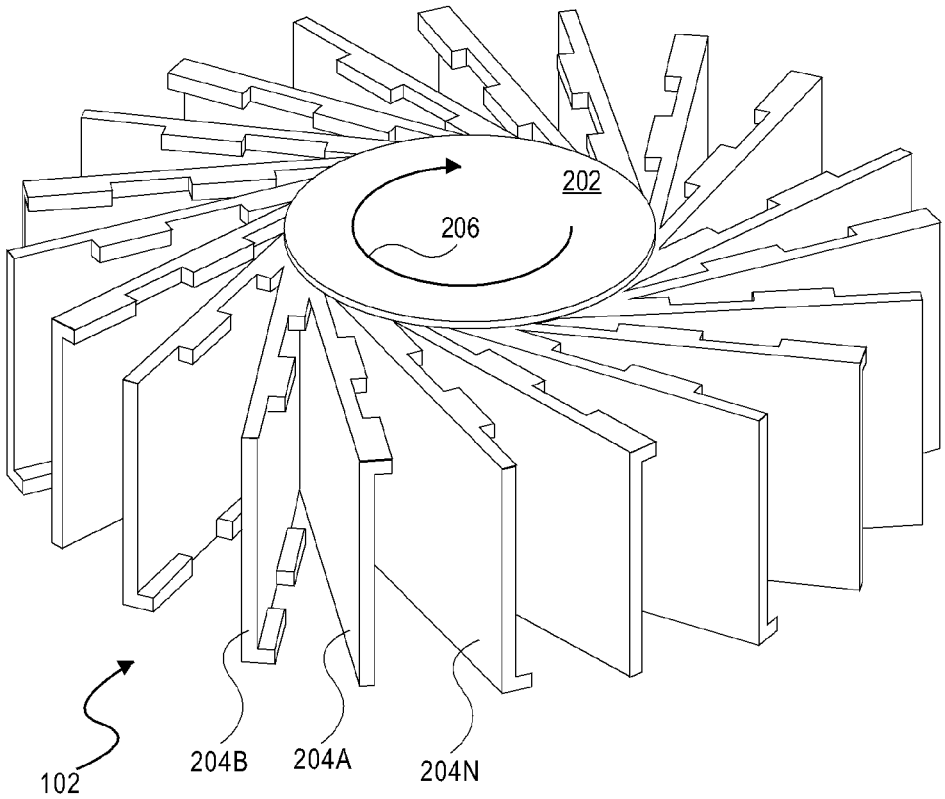
FIGS. 6A and 6B are a perspective view of a fan, and a top view of the fan with a two blades thereof illustrated for illustrative convenience, respectively, according to another embodiment of the invention.
Figure 6B:
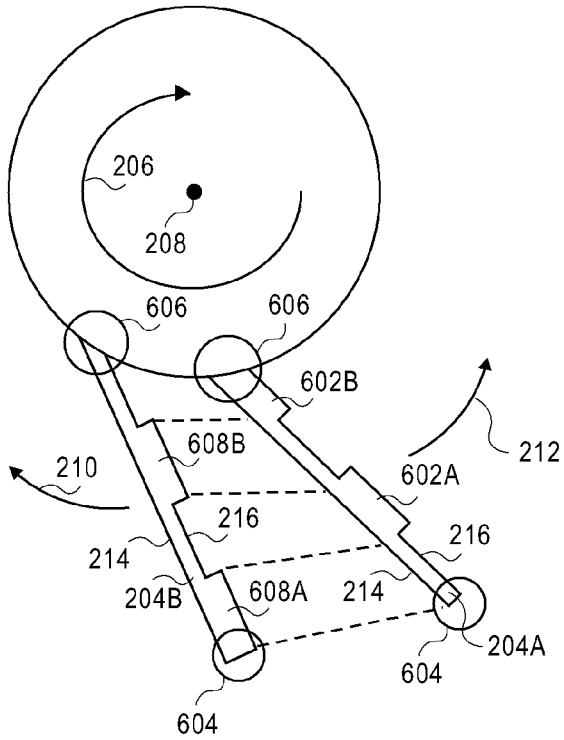

FIGS. 6A and 6B are a perspective view of the fan 102, and a top view of the fan 102 with two blades 204A and 204B thereof illustrated for illustrative convenience, respectively, according to such an embodiment of the invention. In FIG. 6A, the fan 102 is again depicted as having a rotatable center member 202 that rotates in the direction indicated by the arrow 206. As in FIGS. 2A, 3A, 4A, and 5, the blades 204 extend from the rotatable center member 202 in FIG. 6A.

In FIG. 6B, the fan 102 is depicted with just two blades 204A and 204B, as representative of all the blades 204, for illustrative convenience. The two blades 204A and 204B are representative of each successive pair of the blades 204, as can be appreciated by those of ordinary skill within the art. The rotatable center member is shown in FIG. 6B, as in FIG. 2B, as being centered relative to an axis of rotation 208 of the fan 102. The blades 204A and 204B have sides 214 that point in the direction in which the rotatable center member 202, and thus the blades 204A and 204B, rotates, as indicated by the arrows 206 and 210. The blades 204A and 204B also have sides 216 that point in the opposite direction, as indicated by the arrow 212. The blades 204A and 204B have first ends 606 at which the blades 204A and 204B are mounted to or extend from the rotatable center member 202, and second, opposite ends 604.

At its top, the blade 204A has a rib 602 made up of two rib sections 602A and 602B, such that there are notches between the end 604 and the rib section 602A, and between the rib sections 602A and 602B. At its top, the blade 204B has a rib 608 made up of two rib sections 608A and 608B, such that there are notches between the rib sections 608A and 608B, and between the rib section 608B and the end 606. The rib sections 602A and 602B extending from the blade 204A alternate in position as compared to the rib sections 608A and 608B extending from the blade 204B. That is, where there is a rib section extending from the blade 204A, there is a corresponding notch and no rib section extending from the blade 204B. Likewise, where there is a notch and no rib section extending from the blade 204A, there is a corresponding rib section extending from the blade 204B. This alternating pattern of notch-rib section continues for each pair of the blades 204 of the fan 102.

As can best be seen in FIG. 6A, it is also noted that the where there is a notch at the top of the blade 204A, there is a rib section extending from the blade 204A at its bottom. Likewise, where there is a rib section extending from the blade 204A at its top, there is a notch at the bottom of the blade 204B. This alternating pattern of notch-rib between the top and the bottom of a blade exists for each of the blades 204 of the fan 102.

Furthermore, it is noted that in the embodiment of FIGS. 6A and 6B, the ribs made up of a number of rib sections extend from the blades 204 at the sides 216 thereof, pointing in the direction indicated by the arrow 212 that is opposite to the direction in which the rotatable center member 202 rotates, as indicated by the arrows 206 and 210. In another embodiment, however, the ribs made up of a number of rib sections may extend from the blades 204 at the sides 214 thereof, pointing in the direction indicated by the arrow 210, which indicates the direction in which the rotatable center member 202 rotates. In still another embodiment, alternating rib sections extending from the same or different blades 204 may be positioned to either side of the blades 204, in accordance with some pattern. That is, embodiments of the invention are not limited to which particular side a given rib section extends from a given blade.

Figure 7:
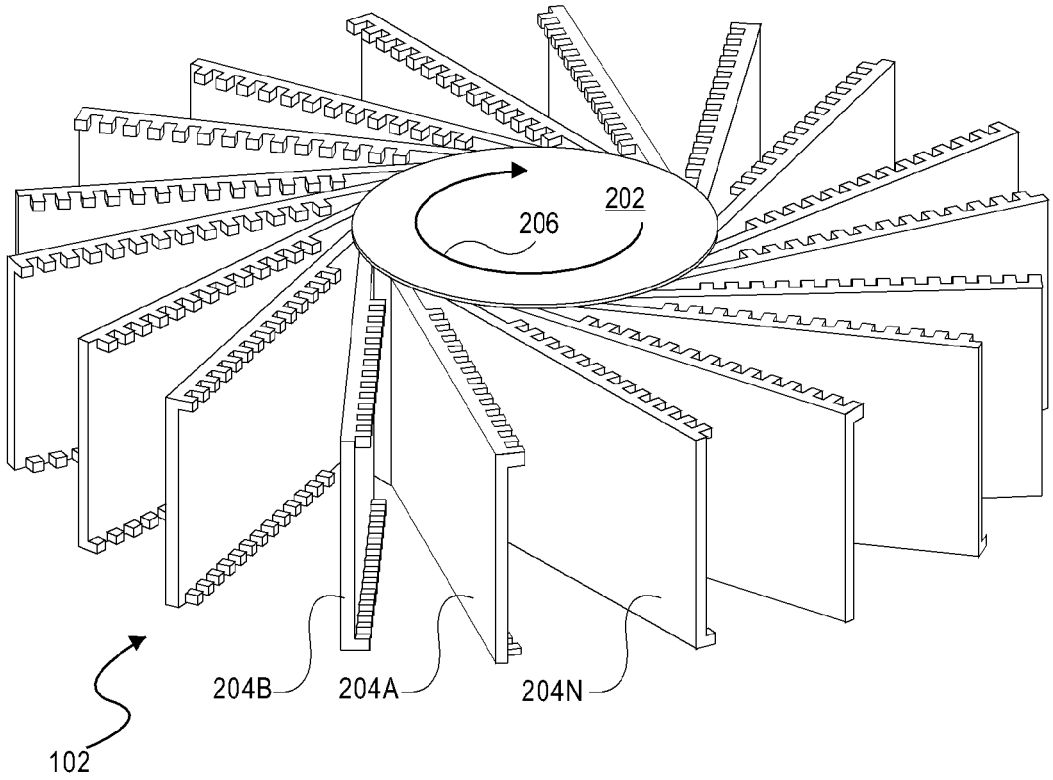
FIG. 7 is a perspective view of a fan, according to another embodiment of the invention.

Furthermore, in the embodiment of FIGS. 6A and 6B, each of the ribs extending from the blades 204 is made up of two rib sections and two notches. However, in another embodiment of the invention, there may be more than two rib sections, and thus more than two notches, within each rib extending from the blades 204. FIG. 7 shows a perspective view of the fan 102, according to such an embodiment of the invention. In FIG. 7, the fan 102 is again depicted as having a rotatable center member 202 that rotates in the direction indicated by the arrow 206. As in FIGS. 2A, 3A, 4A, 5, and 6A, the blades 204 extend from the rotatable center member 202 in FIG. 7.

The embodiment of FIG. 7 is similar to the embodiment of FIGS. 6A and 6B, in that each of the blades 204 has a number of rib sections that define and make up the ribs of the blade. However, whereas in the embodiment of FIGS. 6A and 6B each rib is made up of two rib sections, with two notches, in the embodiment of FIG. 7, each rib is made up of a much larger number of rib sections, with a correspondingly much larger number of notches in-between. Otherwise, the embodiment of FIG. 7 is at least substantially similar to the embodiment of FIGS. 6A and 6B, and the differing modifications that can be made to the embodiment of FIGS. 6A and 6B to yield additional embodiments of the invention can also be made to the embodiment of FIG. 7 to yield additional embodiments of the invention.

In both the embodiment of FIGS. 6A and 6B and the embodiment of FIG. 7, each rib of each blade is notched at equidistant intervals along the length of the blade from the first end to the second end thereof. More generally, however, each rib of each blade is notched at a number of positions along the length of the blade, regardless of whether the notches are equidistant to one another or not. Furthermore, in all the embodiments of the invention that have been thus far described, each of the blades 204 of the fan 102 is flat in shape except for the ribs that extend therefrom.

Figure 8A:
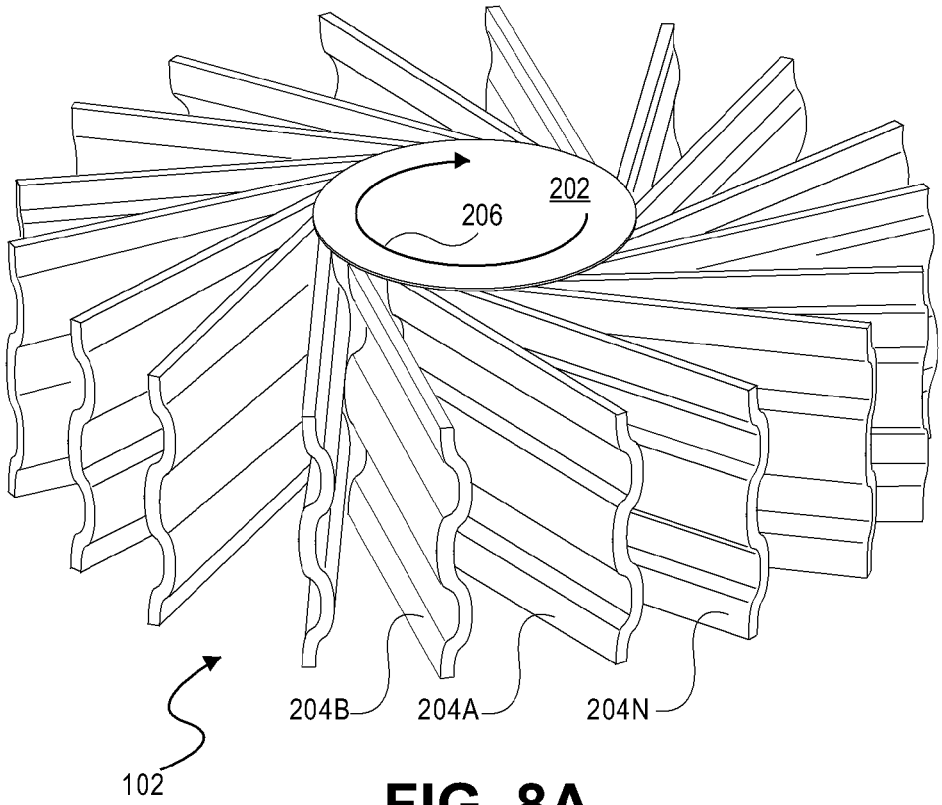
FIGS. 8A and 8B are perspective views of a fan, according to different embodiments of the invention.
Figure 8B:
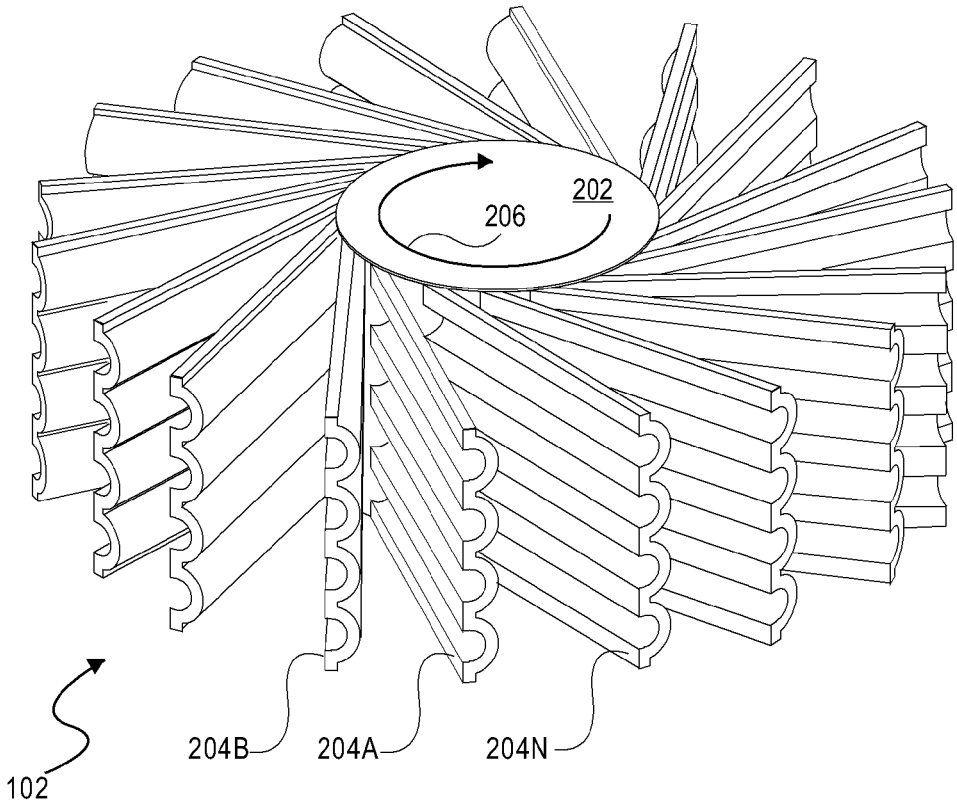

FIGS. 8A and 8B show perspective views of the fan 102, according to different embodiments of the invention. In FIGS. 8A and 8B, the fan 102 is again depicted as having a rotatable center member 202 that rotates in the direction indicated by the arrow 206. As in FIGS. 2A, 3A, 4A, 5, 6A, and 7, the blades 204 extend from the rotatable center member 202 in FIGS. 8A and 8B.

In both FIGS. 8A and 8B, however, each of the blades 204 has a side profile that has a curvy shape, and thus is not flat as each of the blades 204 of the fan 102 are in previously described embodiments of the invention. Curvy is exemplarily, but non-restrictively, defined herein as having curves, where a curve may be considered in one embodiment as a line that deviates from straightness in a smooth, continuous fashion. That is, each of the blades 204 has a side profile that is made up of a series of S- or C-shapes extending from the top of the blade to the bottom of the blade. The difference between FIGS. 8A and 8B is that in the embodiment of FIG. 8A there is a lesser number of individual S or C-shapes within the side profile of each of the blades 204, as compared to the embodiment of FIG. 8B.

Figure 9A:
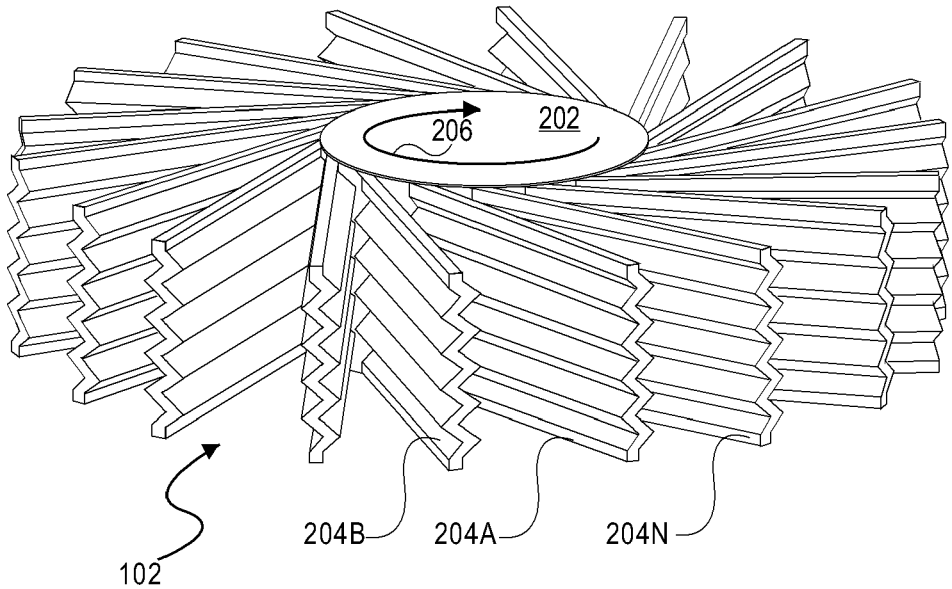
FIGS. 9A and 9B are perspective views of a fan, according to different embodiments of the invention.
Figure 9B:
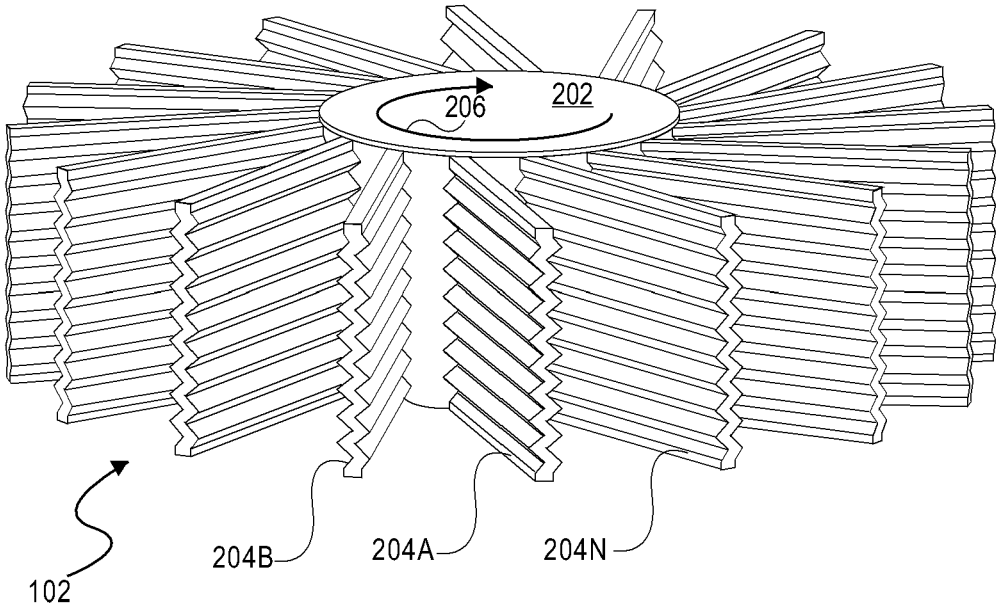

FIGS. 9A and 9B show perspective views of the fan 102, according to different embodiments of the invention. In FIGS. 9A and 9B, the fan 102 is again depicted as having a rotatable center member 202 that rotates in the direction indicated by the arrow 206. As in FIGS. 2A, 3A, 4A, 5, 6A, 7, 8A, and 8B, the blades 204 extend from the rotatable center member 202 in FIGS. 9A and 9B.

In both FIGS. 9A and 9B, each of the blades 204 has a side profile that has a zigzag shape. Zigzag is exemplarily, but non-restrictively, defined herein as a line that proceeds by sharp turns in alternating directions. That is, each of the blades 204 has a side profile that is made up of a series of Z-shapes or sideways V-shapes extending from the top of the blade to the bottom of the blade. The difference between FIGS. 9A and 9B is that in the embodiment of FIG. 9A there is a lesser number of individual Z-shapes or sideways V-shapes within the side profile of each of the blades 204, as compared to the embodiment of FIG. 9B.

Figure 10A:
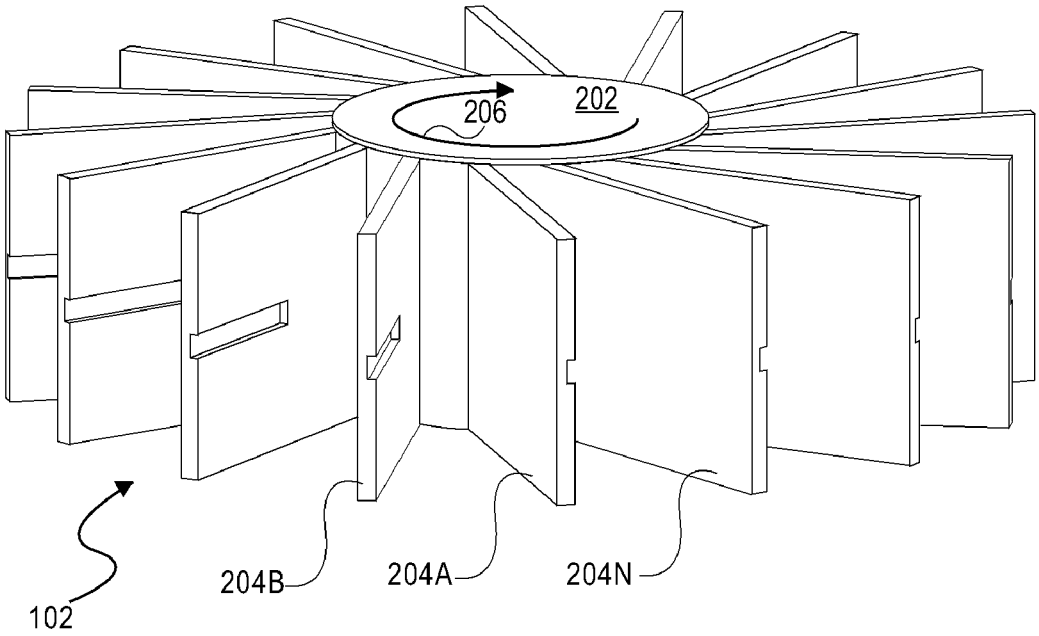
FIGS. 10A and 10B are perspective views of a fan, according to different embodiments of the invention.
Figure 10B:
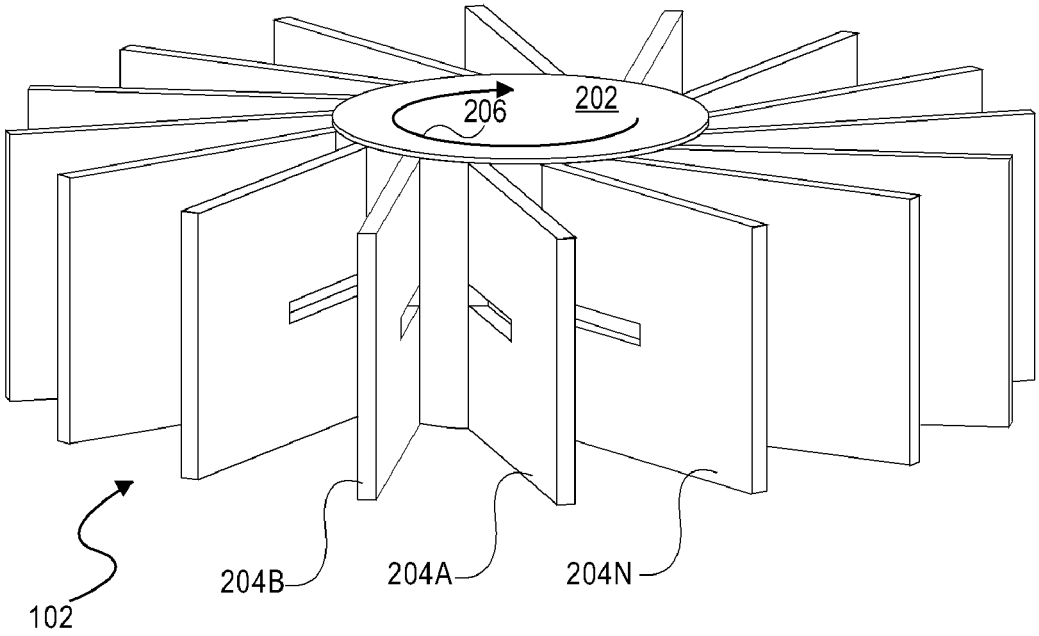

FIGS. 10A and 10B show perspective views of the fan 102, according to different embodiments of the invention. In FIGS. 10A and 10B, the fan 102 is again depicted as having a rotatable center member 202 that rotates in the direction indicated by the arrow 206. As in FIGS. 2A, 3A, 4A, 5, 6A, 7, 8A, 8B, 9A, and 9B, the blades 204 extend from the rotatable center member 202 in FIGS. 10A and 10B.

In FIG. 10A, each of the blades 204 has a notch extending length-wise across the blade, from the end at which the blade is mounted to or extends from the rotatable center member 202, to the opposite end of the blade. (For instance, these are the ends 606 and 604 denoted in FIG. 6B, although the notches of FIG. 10A are not shown in FIG. 6B.) The notches do not extend completely through the blades 204 from side to side, but rather they extend only partially through the blades 204 from side to side. In particular, the notches point in the direction opposite to that in which the rotatable center member 202 is rotating. (For instance, the blades 204 have notches at the sides 216 denoted in FIG. 6B, and the notches do not extend from the sides 216 to the sides 214 denoted in FIG. 6B, although the notches of FIG. 10A are not shown in FIG. 6B.) Furthermore, from the top of the blades 204 to the bottom of the blades 204, the notches are substantially centered at midpoints therebetween. (For instance, these are the top 218 and the bottom 222 denoted in FIG. 2C, although the notches of FIG. 10A are not shown in FIG. 2C.) In other embodiments of the invention, there may be more than one notch within each blade, and the notch or notches of each blade may be differently positioned and may not extend length-wise across the blade, as compared to the embodiment of FIG. 10A.

In FIG. 10B, each of the blades 204 has a hole extending completely through the blade. From the top of the blades 204 to the bottom of the blades 204, the holes are substantially centered at midpoints (on a top-to-bottom basis) therebetween. (For instance, these are the top 218 and the bottom 222 denoted in FIG. 2C, although the holes of FIG. 10B are not shown in FIG. 2C.) Furthermore, where the blades 204 have ends at which the blades are mounted to and extend from the rotatable center member 202, and opposite ends, the holes are located between the former ends of the blades and the midpoints between the former ends and the latter ends. (For instance, these are the ends 606 and 604 denoted in FIG. 6B, although the holes of FIG. 10B are not shown in FIG. 6B.) In other embodiments of the invention, there may be more than one hole within each blade, and the hole or holes of each blade may be different positioned, as compared to the embodiment of FIG. 10B.

In the embodiments of the invention that have been described, the blades 204 of the fan 102 each extend in a straight fashion from the rotatable center member 202. For instance, even in the embodiments of FIGS. 8A, 8B, 9A, and 9B, where the side profiles of the blades 204 are non-linear, the blades 204 on a length-wise basis extend in a straight fashion from the rotatable center member 202. However, in other embodiments of the invention, the blades 204 may not extend in a straight fashion from the rotatable center member 202, as is now described.

Figure 11A:
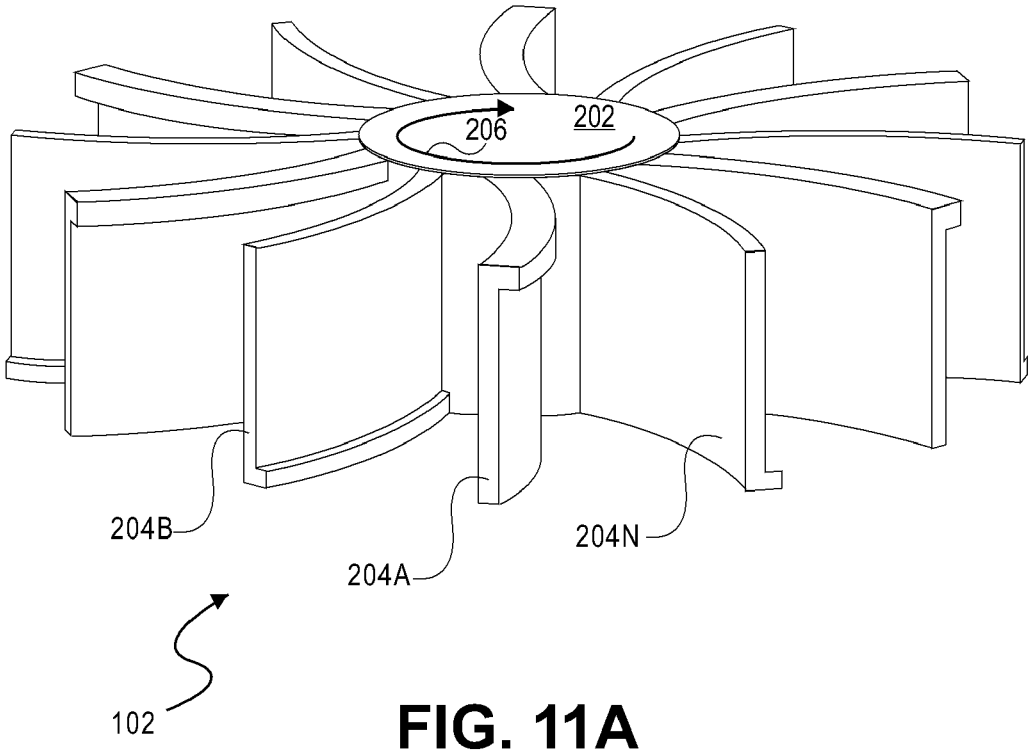
FIGS. 11A and 11B are perspective views of a fan, according to different embodiments of the invention.
Figure 11B:
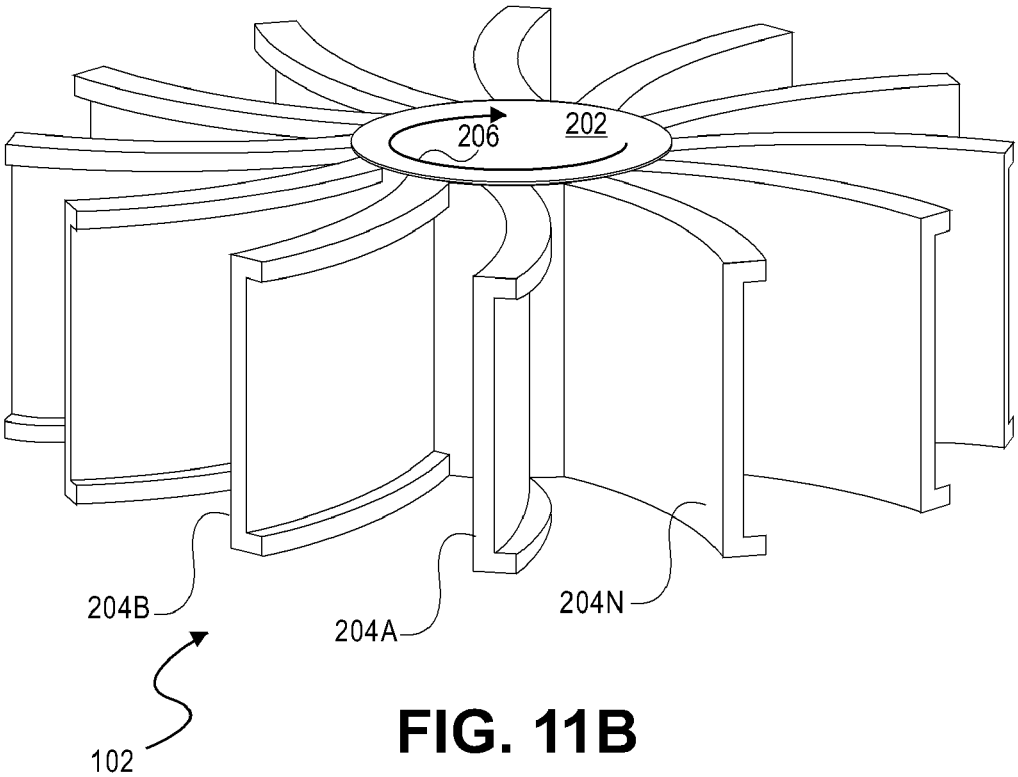

FIGS. 11A and 11B show perspective views of the fan 102, according to different such embodiments of the invention. In FIGS. 11A and 11B, the fan 102 is again depicted as having a rotatable center member 202 that rotates in the direction indicated by the arrow 206. As in FIGS. 2A, 3A, 4A, 5, 6A, 7, 8A, 8B, 9A, 9B, 10A, and 10B, the blades 204 extend from the rotatable center member 202 in FIGS. 11A and 11B.

In both FIGS. 11A and 11B, each of the blades 204 has a cycloidal curvature that curves away from the direction in which the rotatable center member rotates, as indicated by the arrow 206. A cycloid specifically is the curve defined by a fixed point on a wheel as it rolls, or, more precisely, the locus of a point on the rim of a circle rolling along a straight line. The cycloid through the origin, as created by a circle of radius r, includes the following points (x, y):

$$x=r(t-\sin t)$$

$$y=r(1-\cos t) \tag{1}$$

In equation (1), t is a real parameter, equal to the center of the rolling circle. If seen as a function y(x), the cycle is arbitrarily often differentiable everywhere except at the cusps where it hits the x-axis, at which point its slope is infinite. The cycloid satisfies the following differential equation:

$$\left(\frac{dy}{dx}\right)^2 = \frac{2r-y}{y} \tag{2}$$

Curves that are related to the cycloid include the curtate cycloid and the prolate cycloid, which are obtained when the requirement that the fixed point be on the rim of the circle is recycled. In a curtate cycloid, the point tracing out the curve is inside the circle, and in a prolate cycloid, the point tracing out the curve is outside the circle. Another cycloid-related curve is the trochoid, which refers to any of the cycloid, the curtate cycloid, and the prolate cycloid. Furthermore, if the line on which the circle rolls is allowed to be an arbitrary circle (e.g., a straight line is a circle of infinite radius), then the epicycloid, the epitrochoid, the hypocycloid, and the hypotrochoid are obtained. An epicycloid is a circle rolling on the outside of another circle, with the tracing point being on the rim of the rolling circle. An epitrochoid is a circle rolling on the outside of another circle, with the tracing point being anywhere inside the rolling circle. A hypocycloid is a circle rolling on the inside of another circle, with the tracing point being on the rim of the rolling circle. A hypotrochoid is a circle rolling on the inside of another circle, with the tracing point being anywhere inside the rolling circle.

All of these curves are considered as cycloidal curvatures as the term cycloidal curvature is used herein. All such cycloidal curves are roulettes with a circle rolled around a uniform curvature. The cycloid, epicycloid, and the hypocycloid have the property that each is similar to its evolute. For instance, if q is the product of the curvature with the circle's radius, signed position for epi- and negative for hypo-, then the curve:evolute similitude ratio is 1+2q.

The difference between FIGS. 11A and 11B lies in the ribs that extend from the blades 204. In FIG. 11A, the ribs extend from the blades 204 in an alternating top-bottom pattern, such that the blade 204A has a rib extending from its top, the blade 204B has a rib extending from its bottom, and so on. Thus, the embodiment of FIG. 11A can be considered the same as the embodiment of FIG. 5, except that the blades 204 are flat in the latter embodiment and have cycloidal curvatures in the embodiment of FIG. 11A. In FIG. 11B, the ribs extend from the blades 204 on both the top and the bottom of the blades, such that each of the blades 204 has a rib extending from its top and a rib extending from its bottom. Thus, the embodiment of FIG. 11B can be considered the same as the embodiment of FIGS. 2A, 2B, and 2C, except that the blades 204 are flat in the latter embodiment and have cycloidal curvatures in the embodiment of FIG. 11B. In general, any of the embodiments that have been described up to and including FIG. 10B can be modified so that the blades have cycloidal curvatures, as in FIGS. 11A and 11B.

Figure 12:
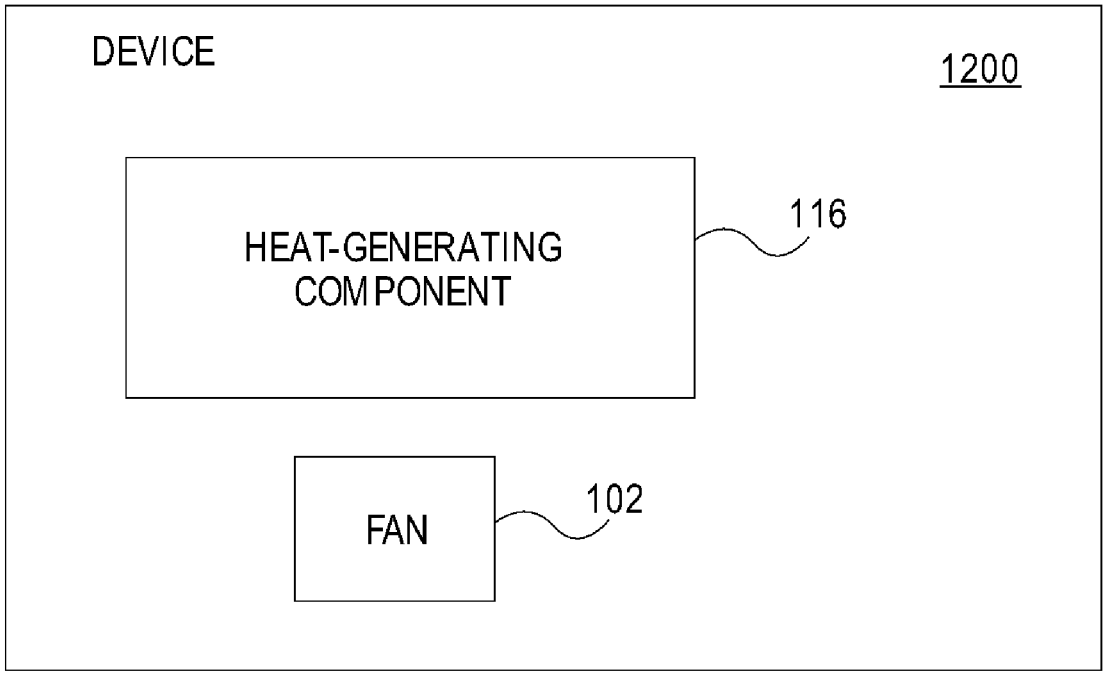
FIG. 12 is a rudimentary block diagram of a device having a fan, according to an embodiment of the invention.

Finally, FIG. 12 shows a rudimentary block diagram of a device 1200, according to an embodiment of the invention. The device 1200 may be a computing device, or another type of device. The device 1200 includes a heat-generating component 116, and a fan 102. The heat-generating component 116 generates heat, and furthermore performs functionality to which the device 1200 is related or associated. For instance, the component 116 may be a processor of a computing device, and thus performs processing or computational functionality. The fan 102 is used to actively cool the component 116. That is, the fan 102 dissipates the heat generated by the component 116 by sucking in heated air or other gas from around the component 116 and exhausting this heated air or other gas.

It is noted that, although specific embodiments have been illustrated and described herein, it will be appreciated by those of ordinary skill in the art that any arrangement calculated to achieve the same purpose may be substituted for the specific embodiments shown. This application is thus intended to cover any adaptations or variations of embodiments of the present invention. For instance, whereas embodiments of the invention have been shown and described such that a fan rotates in a clockwise direction, it may also instead rotate in a counter-clockwise direction. As such, it is manifestly intended that this invention be limited only by the claims and equivalents thereof.

I claim:

1. A fan comprising:

a rotatable center member to rotate in a direction and centered relative to an axis of rotation of the fan; and, a plurality of blades radially extending from the rotatable center member, each blade having a side profile being non-linear and comprising:

a single notch pointed in a direction opposite of the direction in which the rotatable center member rotates, the notch extending only partially through the blade, the notch centered at a midpoint between the top of the blade and the bottom of the blade along an entirety of the notch, and the notch ending at one of a first end of the blade at which the blade is mounted to or extends from the rotatable center member and a second, opposite end of the blade, the notch running parallel to the top and the bottom of the blade along the entirety of the notch, the blade having a lesser thickness at the notch than at all other portions of the blade, wherein the single notch is an only notch in each blade.

* * * * *